US011752764B2

(12) United States Patent
Akiyama

(10) Patent No.: US 11,752,764 B2
(45) Date of Patent: Sep. 12, 2023

(54) LIQUID DISCHARGE APPARATUS, IMAGE FORMING APPARATUS, AND DRIVE WAVEFORM GENERATION METHOD

(71) Applicant: Kohta Akiyama, Kanagawa (JP)

(72) Inventor: Kohta Akiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 17/510,381

(22) Filed: Oct. 26, 2021

(65) Prior Publication Data

US 2022/0143975 A1 May 12, 2022

(30) Foreign Application Priority Data

Nov. 11, 2020 (JP) ..... 2020-188172

(51) Int. Cl.
*B41J 29/38* (2006.01)
*B41J 2/045* (2006.01)

(52) U.S. Cl.
CPC ..... *B41J 2/04588* (2013.01); *B41J 2/04553* (2013.01); *B41J 2/04581* (2013.01)

(58) Field of Classification Search
CPC . B41J 2/04596; B41J 2/04588; B41J 2/04581
See application file for complete search history.

(56) References Cited

U.S. PATENT DOCUMENTS 6,145,949 A * 11/2000 Takahashi ..... B41J 2/04596 347/14
6,830,305 B1 * 12/2004 Takizawa ..... B41J 2/04593 347/15
2009/0244139 A1 * 10/2009 Takahashi ..... B41J 29/38 347/12
2013/0215173 A1 8/2013 Akiyama
2013/0241986 A1 9/2013 Aoki et al.
2013/0323474 A1 12/2013 Gotou et al.
2016/0144620 A1 5/2016 Masuda et al.
2017/0326874 A1 11/2017 Akiyama
(Continued)

FOREIGN PATENT DOCUMENTS

JP H09-104125 4/1997
JP 2009-035011 2/2009
(Continued)

OTHER PUBLICATIONS

U.S. Appl. No. 17/377,866, filed Jul. 16, 2021.

*Primary Examiner* — Lam S Nguyen
(74) *Attorney, Agent, or Firm* — Duft & Bornsen, PC

(57) ABSTRACT

A liquid discharge apparatus is configure to drive nozzles with drive waveforms with which timing of discharge pulses fall within a range where a condition |A−C|<|B−D| is satisfied, where "A" is a discharge velocity of a droplet having a first size when drive units are driven to discharge a droplet having the first size, "B" is a discharge velocity of a droplet having a second size larger than the first size when drive units are driven to discharge a droplet having the second size, "C" is a discharge velocity of a droplet having the first size when drive units are driven to discharge droplets having the first size and the second size, and "D" is a discharge velocity of a droplet having the second size when drive units are driven to discharge droplets having the second size and the first size.

10 Claims, 9 Drawing Sheets

(56) References Cited

U.S. PATENT DOCUMENTS

| | | | | |
|---|---|---|---|---|
| 2019/0077146 | A1* | 3/2019 | Shimazoe | B41J 2/04588 |
| 2019/0217607 | A1 | 7/2019 | Akiyama et al. | |
| 2020/0171828 | A1 | 6/2020 | Matsufuji et al. | |
| 2020/0290352 | A1 | 9/2020 | Akiyama et al. | |

FOREIGN PATENT DOCUMENTS

| | | |
|---|---|---|
| JP | 2013-000951 | 1/2013 |
| JP | 2018-089838 | 6/2017 |

* cited by examiner

LIQUID DISCHARGE APPARATUS, IMAGE FORMING APPARATUS, AND DRIVE WAVEFORM GENERATION METHOD

CROSS-REFERENCE TO RELATED APPLICATIONS

The present application claims priority under 35 U.S.C. § 119 to Japanese Patent Application No. 2020-188172, filed on Nov. 11, 2020. The contents of which are incorporated herein by reference in their entirety.

BACKGROUND OF THE INVENTION

1. Field of the Invention

The present invention relates to a liquid discharge apparatus, an image forming apparatus, and a drive waveform generation method.

2. Description of the Related Art

Nowadays, there are known image forming apparatuses (image recording apparatuses) including an inkjet head, such as printers, facsimile machines, copiers, and plotters. In the image forming apparatus including the inkjet head, the negative electrode of a drive element of each nozzle is grounded as a common electrode. The respective drive waveforms for discharging a plurality of types of droplets having different sizes are generated by different amplifier circuits and selectively supplied to the positive electrode of the drive element of each nozzle. Accordingly, the drive waveform length may be shortened, and the productivity may be improved.

Patent Literature 1 (Japanese Unexamined Patent Application Publication No. H9-104125) discloses an image output apparatus that changes the number of tones for the discharge droplet size due to the drive waveform for each color. The image output apparatus may minimize the load of data transfer or data processing (may reduce the system cost) and may improve the print image quality.

In the case of the image forming apparatus in which the negative electrode of the drive element of each nozzle is grounded as a common electrode, however, there is a resistance component between the drive element of the nozzle and the ground. In particular, there is a high resistance component in the vicinity of the drive element of the nozzle. When the current having the drive waveform for discharging droplets having one of the sizes flows into such a resistance component, potential variations occur on the negative electrode. In a case where potential variations occur on the negative electrode, when the drive element is driven with the drive waveform for discharging droplets having the other size, the drive element exhibits a displacement that is different from the expected one, and the discharge velocity of droplets changes. This causes disadvantages such as a reduction in the landing accuracy of droplets and a decrease in the image quality.

SUMMARY OF THE INVENTION

According to an aspect of the present invention, a liquid discharge apparatus includes a discharge head and at least two waveform feed units. The discharge head is configured to drive each of drive units of nozzles based on a drive waveform to discharge a droplet. The at least two waveform feed units are configured to feed a plurality of types of drive waveforms for generating droplets having different sizes to a positive electrode of each of the drive units having negative electrodes commonly grounded. The waveform feed unit is configured to drive the drive units with drive waveforms with which timing of discharge pulses for discharging droplets fall within a range where a condition $|A-C|<|B-D|$ is satisfied, where "A" is a discharge velocity of a droplet having a first size when a predetermined number of drive units among the drive units of all the nozzles of the discharge head are driven to discharge a droplet having the first size, "B" is a discharge velocity of a droplet having a second size larger than the first size when a predetermined number of drive units among the drive units of all the nozzles of the discharge head are driven to discharge a droplet having the second size, "C" is a discharge velocity of a droplet having the first size when a predetermined number of drive units among the drive units of all the nozzles of the discharge head are driven to discharge a droplet having the first size and a remaining drive unit is driven to discharge a droplet having the second size, and "D" is a discharge velocity of a droplet having the second size when a predetermined number of drive units among the drive units of all the nozzles of the discharge head are driven to discharge a droplet having the second size and a remaining drive unit is driven to discharge a droplet having the first size.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
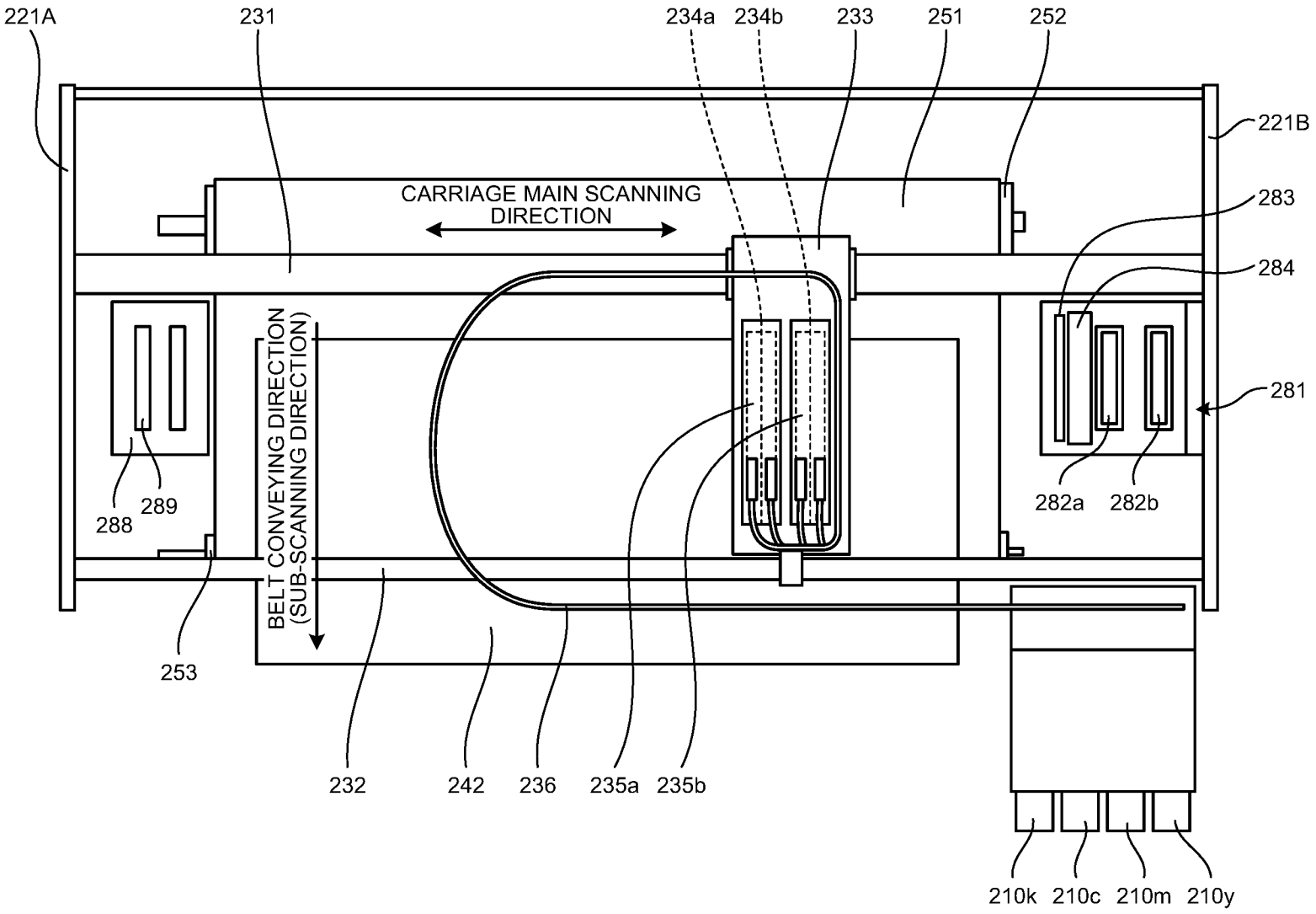
FIG. 1 is a transparent view of a primary part of an image forming apparatus according to a first embodiment when viewed from an upper surface side thereof.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to provide a liquid discharge apparatus, an image forming apparatus, and a drive waveform generation method with which it is possible to optimize the discharge velocity of droplets, improve the landing accuracy of droplets, and improve the image quality.

An image forming apparatus according to an embodiment is described below with reference to the drawings.

First Embodiment

Overall Configuration

Figure 2:
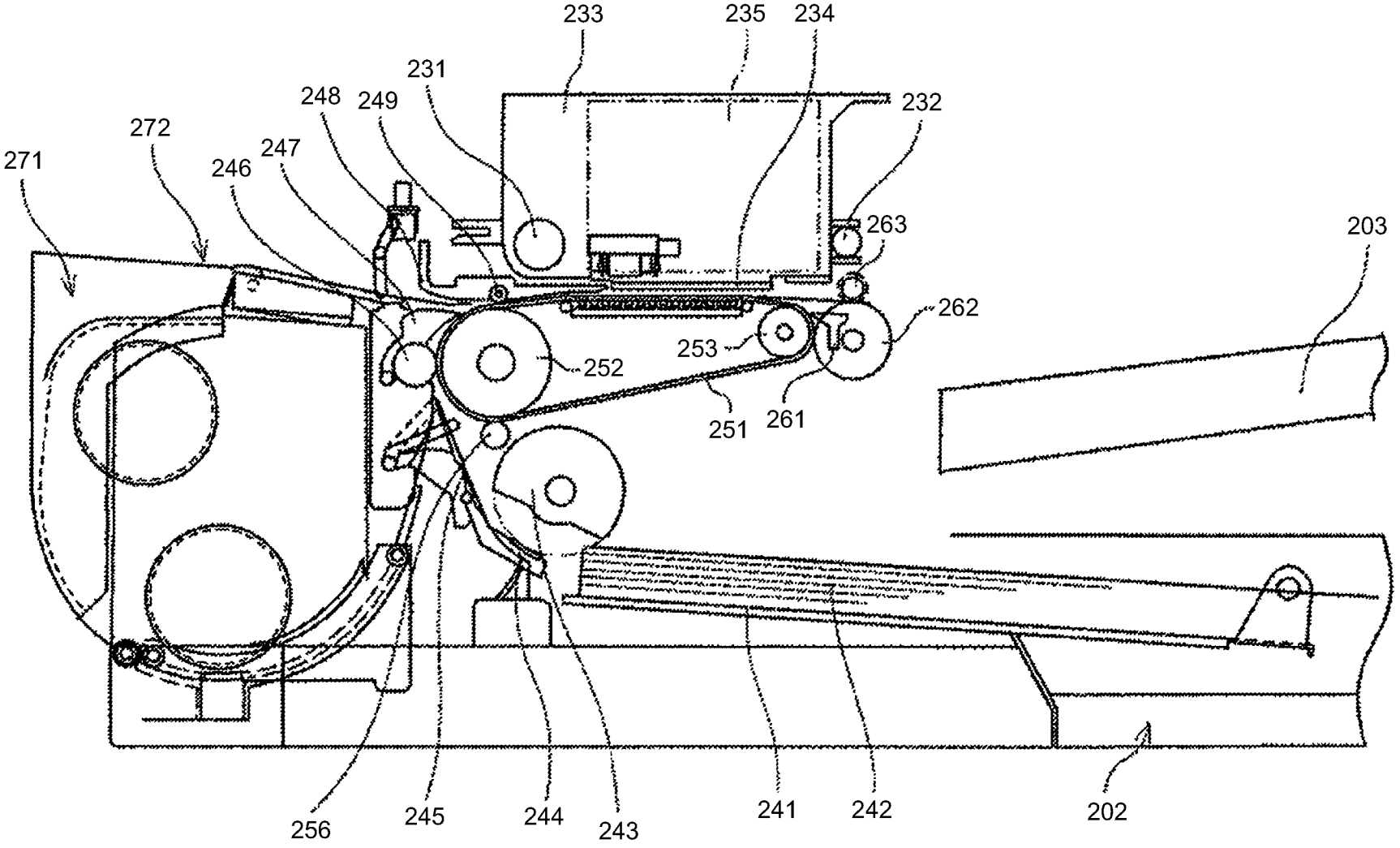
FIG. 2 is a cross-sectional view of the image forming apparatus according to the first embodiment on a vertical cross-section along a conveying direction of a sheet.

FIG. 1 is a transparent view of a primary part of an image forming apparatus according to a first embodiment when viewed from an upper surface side thereof. FIG. 2 is a cross-sectional view of the image forming apparatus according to the first embodiment on a vertical cross-section along a conveying direction of a sheet (an example of a discharge target). The image forming apparatus according to the first embodiment illustrated in FIGS. 1 and 2 is what is called a serial-engine type image forming apparatus that moves a discharge head in a main scanning direction perpendicular to the conveying direction of a sheet to discharge droplets. The image forming apparatus according to the first embodiment slidably holds a carriage 233 along a carriage main scanning direction indicated by an arrow with guide rods 231 and 232 that are a pair of guide members bridging laterally between right and left side plates 221A and 221B. The carriage 233 is driven by a main scanning motor via a timing belt. Accordingly, the carriage 233 executes moving and scanning along the carriage main scanning direction.

The carriage 233 includes recording heads 234*a* and 234*b* (referred to as "recording head 234" when not distinguished) that discharge ink droplets in respective colors of yellow (Y), cyan (C), magenta (M), and black (K). The recording head 234 is an example of a discharge head. The recording head 234 is formed by arranging a nozzle array including a plurality of nozzles in a sub-scanning direction perpendicular to the main scanning direction. Each of the nozzles is provided in the recording head 234 such that an ink droplet discharge direction is a downward direction.

Each of the recording heads 234 includes two nozzle arrays. One of the nozzle arrays of the recording head 234*a* discharges black (K) droplets, and the other nozzle array discharges cyan (C) droplets. One of the nozzle arrays of the recording head 234*b* discharges magenta (M) droplets, and the other nozzle array discharges yellow (Y) droplets.

The carriage 233 includes head tanks 235*a* and 235*b* (referred to as "head tank 235" when not distinguished) that supply ink in the respective colors corresponding to the nozzle arrays of the recording heads 234. Ink in the respective colors is supplied from ink cartridges 210*k*, 210*c*, 210*m*, and 210*y* in the respective colors to the head tanks 235 via supply tubes 236 in the respective colors.

Next, as illustrated in FIG. 2, the image forming apparatus according to the first embodiment includes a sheet feeding unit that feeds a sheet 242 stacked on a sheet stack unit (pressure plate) 241 of a sheet feeding tray 202. The sheet feeding unit includes a semicircular roller (sheet feeding roller) 243 that separates and feeds the sheets 242 one by one from the sheet stack unit 241, and a separation pad 244 that is made of a material having a high friction coefficient and is provided to be opposed to the sheet feeding roller 243. The separation pad 244 is biased against the sheet feeding roller 243.

The image forming apparatus according to the first embodiment includes a guide member 245 that guides the sheet 242 fed from the sheet feeding unit and a counter roller 246 to feed the sheet 242 to a lower side of the recording head 234. The image forming apparatus according to the first embodiment includes a conveyance guide member 247 and a pressing member 248 including a leading-edge pressure roller 249. The image forming apparatus according to the first embodiment includes a conveyance belt 251 that electrostatically attracts the fed sheet 242 and conveys the sheet 242 to a position opposed to the recording head 234.

The conveyance belt 251 is an endless belt extending between a conveyance roller 252 and a tension roller 253. The image forming apparatus according to the first embodiment includes a charge roller 256 that charges a surface of the conveyance belt 251. The charge roller 256 is provided to come into contact with a surface layer of the conveyance belt 251 and rotate in accordance with the rotation of the conveyance belt 251. When the conveyance roller 252 is driven to rotate by the sub-scanning motor via the timing belt, the conveyance belt 251 rotates and moves in a belt conveying direction (sub-scanning direction).

The image forming apparatus according to the first embodiment includes a paper ejection unit that ejects the sheet 242 recorded by the recording head 234. The paper ejection unit includes a paper ejection roller 262, a paper ejection roller 263, and a separation claw 261 that separates the sheet 242 from the conveyance belt 251. A paper ejection tray 203 is provided below the paper ejection roller 262.

A double-sided unit 271 is detachably attached to a back surface portion of the image forming apparatus according to the first embodiment. The double-sided unit 271 receives and reverses the sheet 242 that is returned due to the reverse rotation of the conveyance belt 251 and feeds the sheet 242 again between the counter roller 246 and the conveyance belt 251. A bypass feeder 272 is provided on an upper surface of the double-sided unit 271.

As illustrated in FIG. 1, a maintenance/recovery mechanism 281 that maintains and recovers the state of the nozzle of the recording head 234 is provided in a non-printing area on one end side of the carriage 233 along the scanning direction. The maintenance/recovery mechanism 281 includes cap members (hereinafter referred to as "cap") 282*a* and 282*b* (referred to as "cap 282" when not distinguished) that cap the respective nozzle surfaces of the recording heads 234. The maintenance/recovery mechanism 281 includes a wiper blade 283 that wipes the nozzle surface and an idle discharge receiver 284 that discharges the droplets for idle discharge. Idle discharge is performed to discharge thickened droplets that are not suitable for recording.

An ink collection unit (idle discharge receiver) 288 that is a liquid collection container for discharged droplets of idle discharged is provided in a non-printing area on the other end side of the carriage 233 along the scanning direction. The ink collection unit 288 includes an opening 289 along the nozzle array direction of the recording head 234.

In the image forming apparatus according to the first embodiment as described above, the sheet 242 is separated one by one from the sheet feeding tray 202 and is fed substantially in a vertical and upward direction. The fed sheet 242 is guided by the guide member 245 and is conveyed while being nipped between the conveyance belt 251 and the counter roller 246. The leading edge of the sheet 242 is further guided by the conveyance guide member 247, the sheet 242 is pressed against the conveyance belt 251 by the leading-edge pressure roller 249, and the conveying direction is changed by substantially 90°.

At this point, a positive potential and a negative potential are alternately and repeatedly applied (an alternating voltage is applied) to the charge roller 256. This causes, on the conveyance belt 251, a charge voltage pattern formed, in which the positive potential and the negative potential are alternately charged in a band shape having a predetermined width in the sub-scanning direction, which is a rotation direction. When the sheet 242 is fed onto the conveyance belt 251 where the charge voltage pattern is formed, the sheet 242 is attracted to the conveyance belt 251, and the sheet 242 is conveyed in the sub-scanning direction due to the rotation movement of the conveyance belt 251.

Therefore, the recording head 234 is driven in response to an image signal while the carriage 233 is moved so that an object, such as character or image, corresponding to one line is recorded with ink droplets discharged onto the stopped sheet 242 and, after the sheet 242 is conveyed by a predetermined amount, an object in the subsequent line is recorded. When a recording end signal is received or it is detected that the trailing edge of the sheet 242 has reached a recording area, the recording operation ends and the sheet 242 is ejected to the paper ejection tray 203.

Configuration of Recording Head

Figure 3:
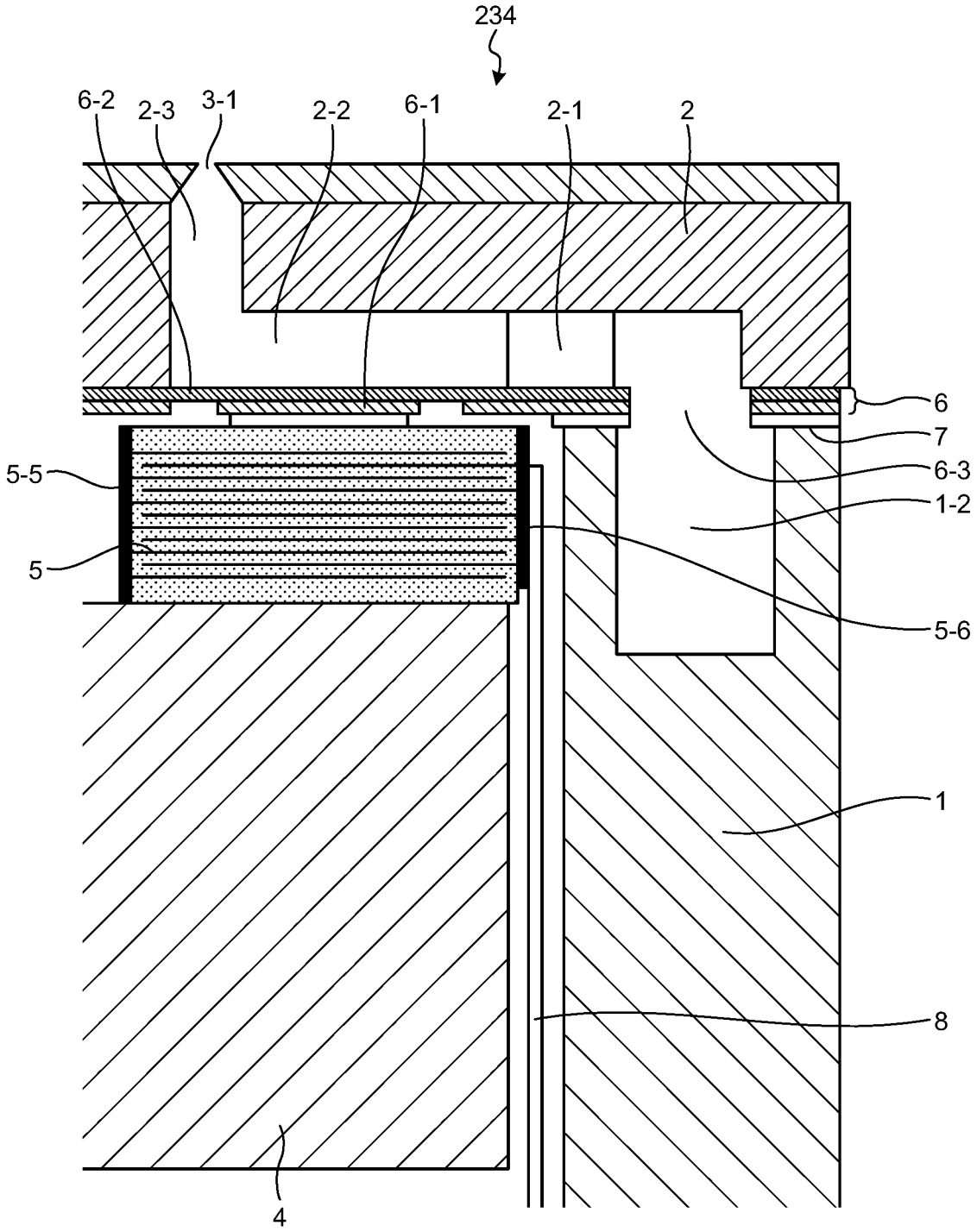
FIG. 3 is a cross-sectional view of a recording head along a longitudinal direction of a liquid chamber of a liquid discharge unit.
Figure 4:
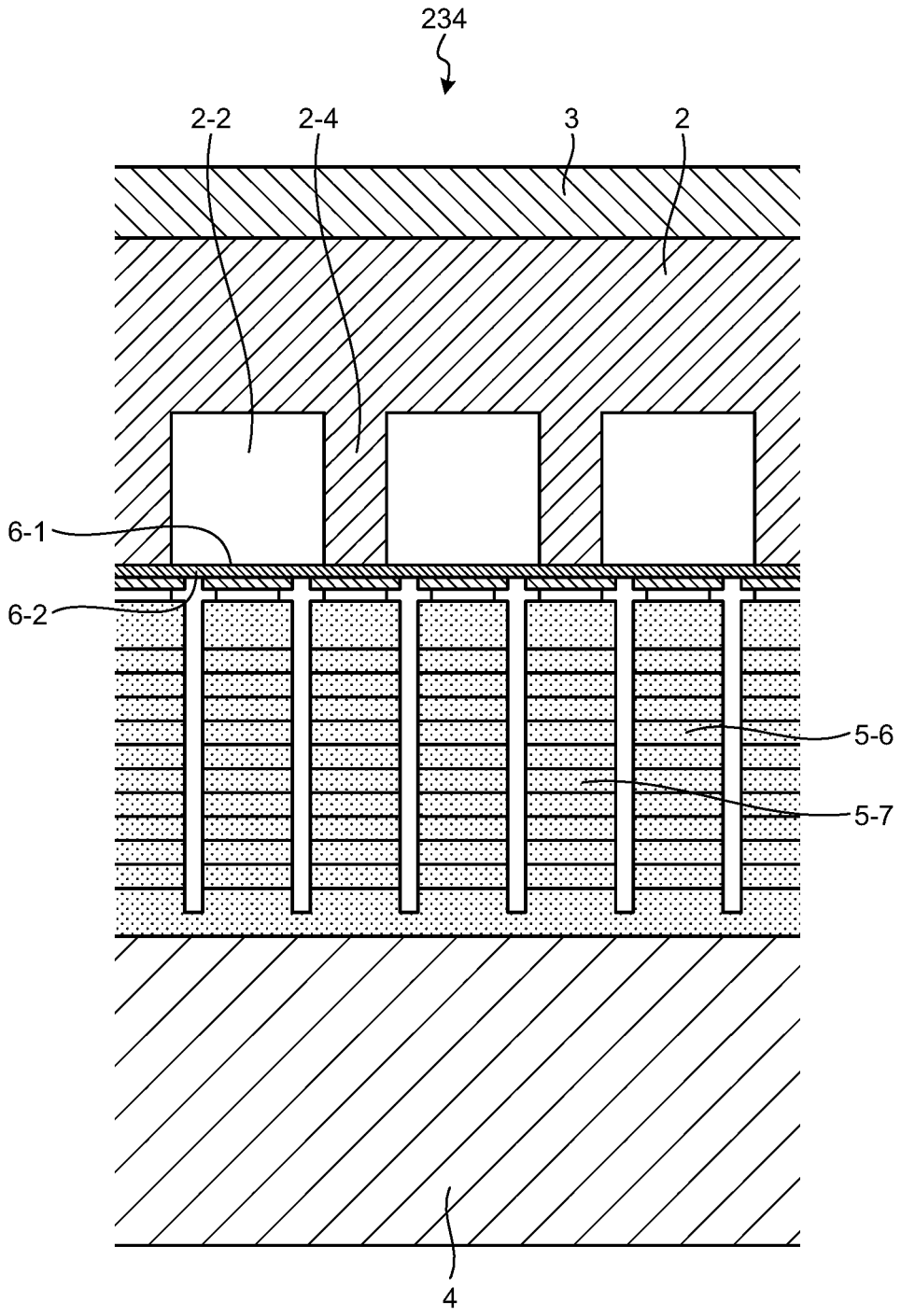
FIG. 4 is a cross-sectional view of the recording head along a lateral direction of the liquid chamber of the liquid discharge unit.
Figure 5:
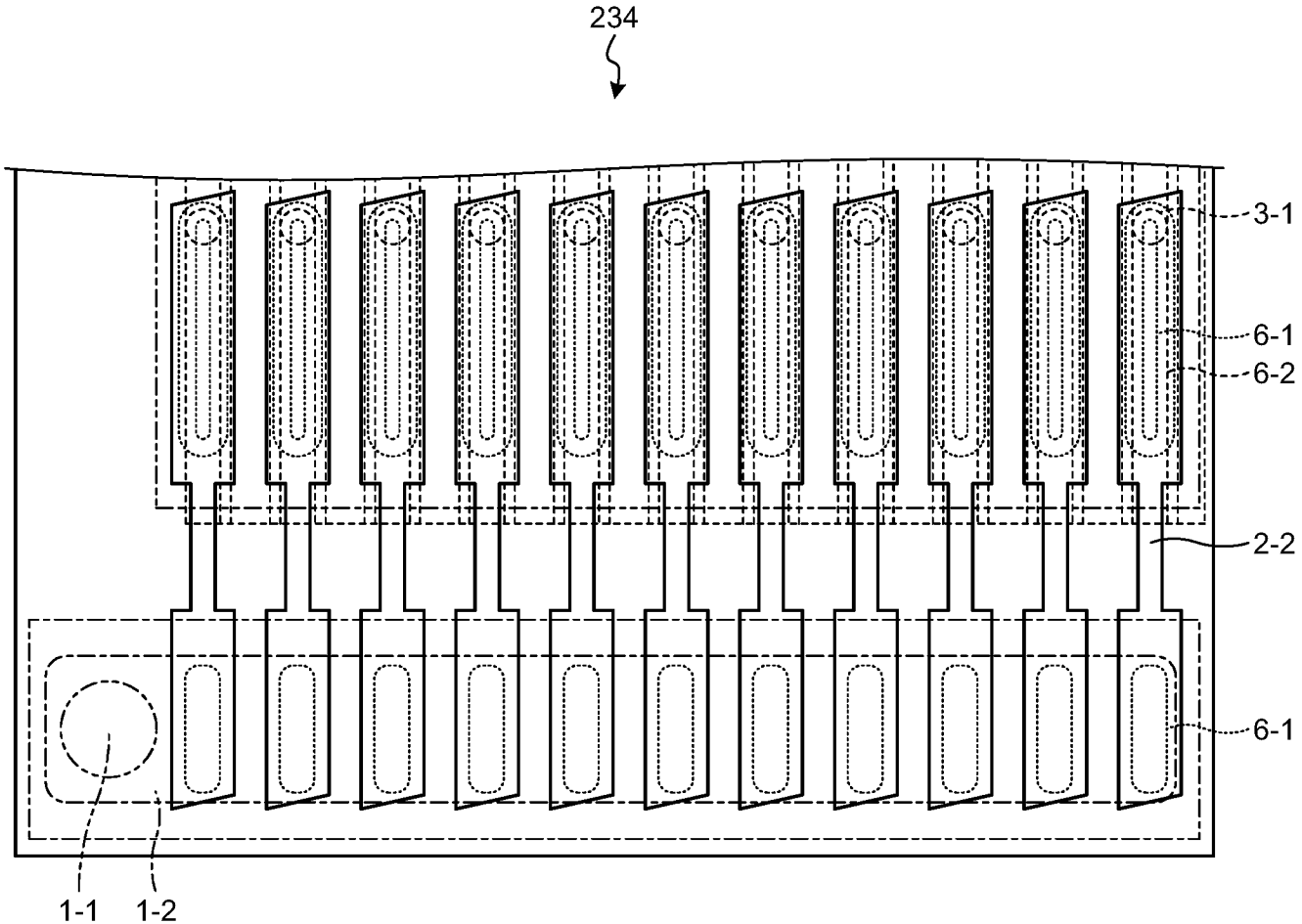
FIG. 5 is a cross-sectional view of the recording head along a plane direction of the liquid chamber of the liquid discharge unit.

Next, the recording head 234 is described. FIG. 3 is a cross-sectional view of the recording head 234 along a longitudinal direction of a liquid chamber of a liquid discharge unit. FIG. 4 is a cross-sectional view of the recording head 234 along a lateral direction of the liquid chamber of the liquid discharge unit. FIG. 5 is a cross-sectional view of the recording head 234 along a plane direction of the liquid chamber of the liquid discharge unit.

As illustrated in FIGS. 3 to 5, the recording head 234 includes a frame 1 that has formed etching serving as an ink supply port 1-1 and a common liquid chamber 1-2. The recording head 234 includes a flow path plate 2 that has formed etching serving as a fluid resistance portion 2-1 and a pressure generation chamber 2-2 and a communication port 2-3 communicating with a nozzle 3-1. The recording head 234 includes a nozzle plate 3 having formed the nozzle 3-1 and a diaphragm 6 including a protrusion portion 6-1, a diaphragm portion 6-2, and an ink inlet port 6-3. The recording head 234 includes a piezoelectric element 5 bonded to the diaphragm 6 via an adhesive layer 7 and a base 4 to which the piezoelectric element 5 is secured. The base 4 is made of a barium titanate-based ceramic and has the piezoelectric elements 5 arranged and bonded in two rows.

The piezoelectric element 5 is formed by alternately laminating a piezoelectric layer formed of one layer of lead zirconate titanate (PZT) and having a thickness of 10 μm to 50 μm and an internal electrode layer formed of one layer of silver palladium (AgPd) and having a thickness of several μm. Both ends of the internal electrode layer are connected to an external electrode.

The piezoelectric element 5 is divided like comb teeth by half cut dicing processing and has a drive unit 5-6 and a support unit 5-7 (non-drive unit) alternately formed. An outer side of the external electrode is divided by half cut dicing processing and has a plurality of individual electrodes whose length is limited by cutout processing, or the like. The other side is conductive without being divided by dicing and serves as a common electrode 5-5.

A flexible substrate (FPC) 8 is bonded by soldering to the individual electrodes of the drive unit. The common electrode 5-5 is bonded to a ground electrode (GND electrode) of the FPC 8 via an electrode layer provided at the end of the piezoelectric element 5. The FPC 8 includes a driver circuit (driver IC). The driver IC applies and controls a drive voltage to the drive unit 5-6.

The diaphragm 6 includes the diaphragm portion 6-2 that is a thin film. An island-shaped protrusion portion (island portion) 6-1 for bonding with the drive unit 5-6 (the piezoelectric element 5) is provided at a central portion of the diaphragm portion 6-2. The diaphragm 6 includes a thick film portion including a beam for bonding with the support unit 5-7, and an opening serving as the ink inlet port 6-3 formed by laminating two layers of Ni plating films by an electroforming method. As an example, the diaphragm portion 6-2 has a thickness of 3 μm and a width of 35 μm (one side).

Patterning of the adhesive layer 7 including a gap material causes bonding between the island-shaped protrusion portion 6-1 of the diaphragm 6 and the drive unit 5-6 of the piezoelectric element 5 and between the diaphragm 6 and the frame 1.

The flow path plate 2 is formed of a silicon single crystal substrate. The flow path plate 2 has formed etching serving as the fluid resistance portion 2-1 and the pressure generation chamber 2-2 and has formed the communication port 2-3 at the position corresponding to the nozzle 3-1 by patterning using an etching technique. The remaining portion after etching serves as a partition wall 2-4 of the pressure generation chamber 2-2. The recording head 234 includes the fluid resistance portion 2-1 that is formed by reducing the etching width.

The nozzle plate 3 is formed of a metal material such as an Ni plating film by for example an electroforming method. The nozzle plate 3 has a large number of the nozzles 3-1 formed as fine discharge ports for discharging ink droplets. As an example, the internal shape (inner shape) of the nozzle 3-1 is a horn shape (may be substantially a cylindrical shape or substantially a truncated cone shape). As an example, the diameter of the nozzle 3-1, i.e., the diameter at the ink droplet outlet side, is approximately 20 μm to 35 μm. As an example, the nozzle pitch in each array is 150 dpi (dots per inch).

A water-repellent layer 3-2, which has undergone a water-repellent surface treatment, is provided on the ink discharge surface (nozzle surface side) of the nozzle plate 3. As the water-repellent layer 3-2, it is possible to use the one obtained by, for example, PTFE-Ni eutectoid plating (nickel Teflon (registered trademark) eutectoid plating), electrodeposition coating of fluororesin, and vapor deposition coating of evaporative fluororesin (e.g., pitch fluoride). As the water-repellent layer 3-2, it is possible to provide a water-repellent film selected in accordance with the ink physical property such as baking after coating a solvent of silicone resin/fluororesin. Accordingly, the droplet shape and the spread characteristics of ink may be stabilized, and a high image quality may be obtained.

The frame 1, which has formed etching serving as the ink supply port 1-1 and the common liquid chamber 1-2, is formed by resin molding.

In the recording head 234, a drive waveform (pulse voltage of 10 V to 50 V) corresponding to a recording signal is applied to the drive unit 5-6. Accordingly, a displacement occurs in the drive unit 5-6 in the laminating direction, and the pressure in the pressure generation chamber 2-2 increases due to the pressure applied via the diaphragm 6 so that droplets such as ink are discharged through the nozzle 3-1.

After the discharge of droplets ends, the pressure in the pressure generation chamber 2-2 decreases, and a negative pressure occurs in the pressure generation chamber 2-2 due to the inertia of the flow of droplets and the discharge process of the drive pulse, which causes a transition to an ink filling process. At this point, the ink supplied from the ink tank flows into the common liquid chamber 1-2, passes the fluid resistance portion 2-1 from the common liquid chamber 1-2 through the ink inlet port 6-3, and is loaded in the pressure generation chamber 2-2.

While the fluid resistance portion 2-1 is effective in damping the residual pressure oscillation after discharge, the fluid resistance portion 2-1 becomes a resistance to refilling due to surface tension. Appropriate selection of the fluid resistance portion 2-1 makes it possible to adjust the balance between the damping of the residual pressure and the refilling time and to shorten the time (drive cycle) before the transition to the subsequent ink droplet discharge operation.

Electrical Configuration of Primary Part

Figure 6:
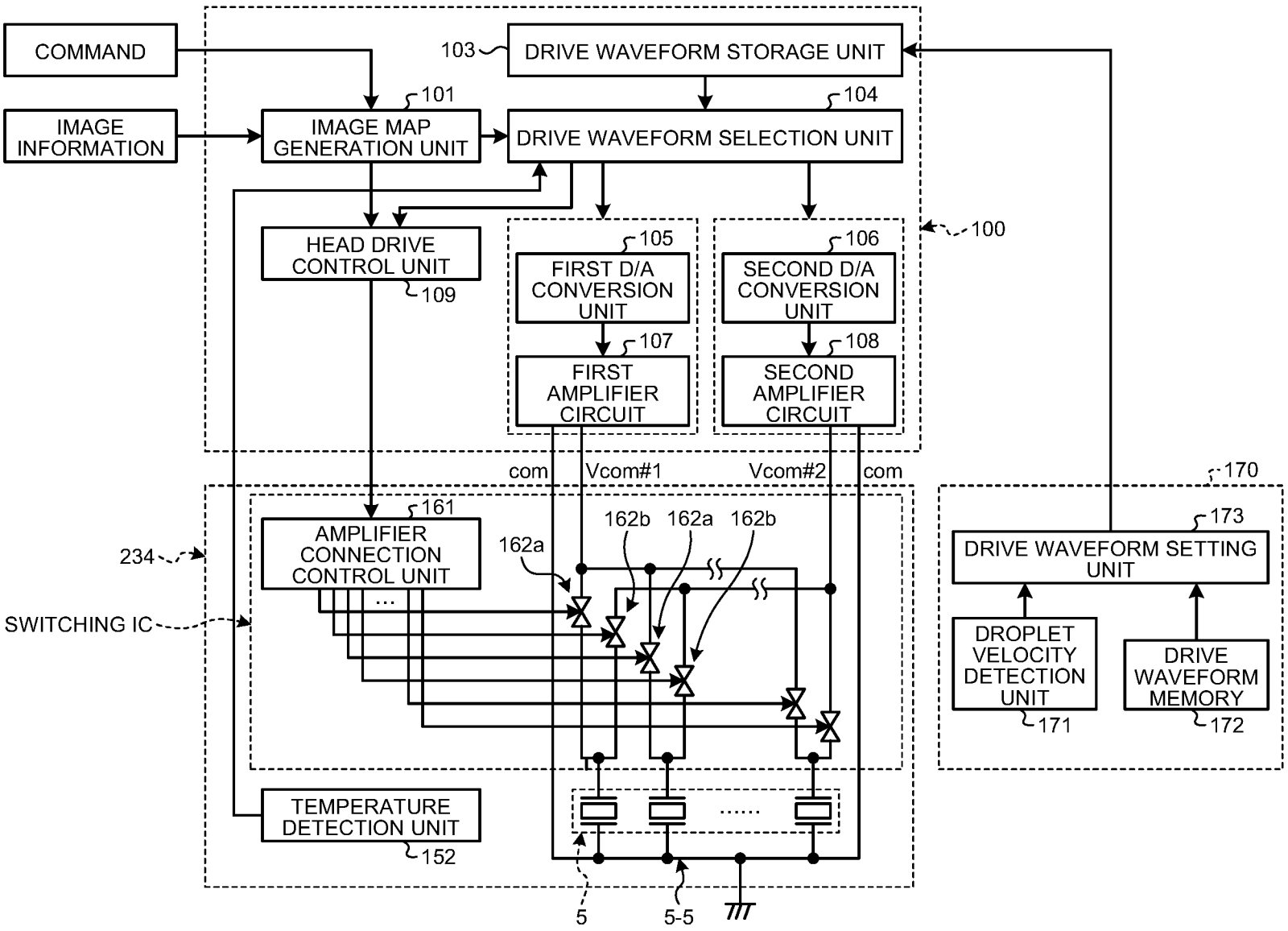
FIG. 6 is a block diagram of a primary part of the image forming apparatus according to the first embodiment.

FIG. 6 is a block diagram of a primary part of the image forming apparatus according to the first embodiment. FIG. 6 illustrates an electrical configuration of the recording head 234, a control unit 100 that drives and controls the recording head 234, and a drive waveform setting control unit 170 that sets drive waveform data on each droplet type for the control unit 100. As illustrated in FIG. 6, the control unit 100 includes an image map generation unit 101 that generates a droplet type map that specifies a droplet type (large droplet, medium droplet, or small droplet) of each nozzle of the recording head 234 based on image information and a print start command.

The control unit 100 includes a drive waveform selection unit 104 that selects a waveform for large droplets, a waveform for medium droplets, or a waveform for small droplets. The drive waveform selection unit 104 selects the waveform for large droplets, the waveform for medium droplets, or the waveform for small droplets stored in a drive waveform storage unit 103 based on the image information fed from the image map generation unit 101 and the temperature detected by a temperature detection unit 152. Drive waveform data indicating the selected waveform is fed to a first digital/analog conversion unit (first D/A conversion unit) 105 and a second digital/analog conversion unit (second D/A conversion unit) 106.

The control unit 100 includes a first amplifier circuit 107 that amplifies the current and voltage of a drive waveform signal fed from the first D/A conversion unit 105 and a second amplifier circuit 108 that amplifies the current and voltage of a drive waveform signal fed from the second D/A conversion unit 106. The first amplifier circuit 107 and the second amplifier circuit 108 are examples of a waveform feed unit.

The control unit 100 includes a head drive control unit 109 that controls an amplifier connection control unit 161 of the recording head 234 based on the droplet type map generated by the image map generation unit 101 and the drive waveform data selected by the drive waveform selection unit 104.

Meanwhile, the recording head 234 includes the piezoelectric element 5 to discharge droplets from each of the nozzles. The negative electrode of each of the piezoelectric elements 5 is the common electrode 5-5 as described above and is bonded to the ground electrode (GND electrode) of the FPC 8 (the negative electrode is commonly grounded).

The recording head 234 includes first switches **162*a* that feed the drive waveform signals from the first amplifier circuit 107 to the individual electrodes on the positive side in each of the piezoelectric elements 5 and second switches 162*b* that feed the drive waveform signals from the second amplifier circuit 108 to the individual electrodes on the positive side in each of the piezoelectric elements 5**.

The recording head 234 includes the amplifier connection control unit 161 that performs control to switch the first switch **162*a* and the second switch 162*b* such that the drive waveform signal from either the first amplifier circuit 107 or the second amplifier circuit 108 is fed to each of the piezoelectric elements 5 under the control of the head drive control unit 109**.

For commercial use printing, industrial use printing, and the like, which puts a significance on the output result of discharged droplets, discharge correction, what is called "shading correction", may be performed to adjust the amount of discharge from the recording head 234 so as to achieve a uniform liquid density on a predetermined area of a discharge target. The head drive control unit 109 controls the amplifier connection control unit 161 such that the abundance ratio of droplets having different sizes is changed for each of the recording heads 234 or for each predetermined region to which droplets are discharged, thereby controlling the execution of the shading correction. Specifically, the liquid density on the discharge target is quantitatively measured, and the result is fed back to the head drive control unit 109. The head drive control unit 109 controls the amplifier connection control unit 161 based on the fed-back liquid density such that the abundance ratio of droplets having different sizes is changed for each of the recording heads 234 or for each predetermined region to which droplets are discharged.

As an example, for quantitative evaluation of the amount of liquid, for example, in the case of a sheet or film, an image is printed on a print target, and the optical density of the print target is measured by using a spectrophotometric colorimeter. For feedback control on discharge correction, the image map generation unit 101 or a device such as a personal computer, which is a higher-level model, adjusts an arrangement pattern such as the presence or absence and the size of droplets such that the liquid density falls within the desired range.

The feedback control on discharge correction may be performed by adjusting the pattern data on the drive waveform signal stored in the drive waveform storage unit 103 in units of heads or in units of the first D/A conversion unit 105 and the second D/A conversion unit 106. The feedback control on discharge correction may be performed by changing the amplification factor in units of the first amplifier circuit 107 and the second amplifier circuit 108.

The drive waveform setting control unit 170 includes a droplet velocity detection unit 171 that, at the time of design of the drive waveform, detects the velocity (droplet velocity) at which droplets are discharged from each of the nozzles, and a drive waveform memory 172 that stores a plurality of patterns of drive waveform data for each droplet type. The drive waveform setting control unit 170 further includes a drive waveform setting unit 173 that, based on the droplet velocity of each of the nozzles detected by the droplet velocity detection unit 171, selects a drive waveform stored in the drive waveform memory 172 and sets the selected drive waveform in the drive waveform storage unit 103 so that small droplets have smaller variations with respect to the target velocity than large droplets during mixed driving for large droplets and small droplets. Thus, it is possible to set a drive waveform with which small droplets may be discharged at a velocity close to the target velocity even when the number of drive nozzles is changed and to improve the image quality.

Although the image forming apparatus according to the first embodiment includes the drive waveform setting control unit 170 as illustrated in FIG. 6, the drive waveform setting control unit 170 may be included as an external device that is physically different from the image forming apparatus according to the first embodiment.

The drive waveform memory 172 and the drive waveform setting unit 173 are examples of a drive waveform generation unit.

Problem Due to Common Electrode Configuration

Here, for inkjet image forming apparatuses, it is necessary to shorten the waveform length in order to improve the drive frequency for discharge. Therefore, instead of the method for selectively generating large droplets and small droplets from one common drive waveform, a method is used in which different drive waveforms are simultaneously generated by the first amplifier circuit 107 and the second amplifier circuit 108 and the drive waveform is selectively applied to each of the piezoelectric elements 5 via either the first switch 162*a* or the second switch 162*b*, as described with reference to FIG. 6.

According to this method, the potential difference occurring between the individual electrode and the common electrode of the piezoelectric element 5 due to the selected drive waveform causes a displacement of the piezoelectric element 5, and its energy causes discharge of droplets such as ink.

In the circuit configuration described with reference to FIG. 6, the individual electrode of the piezoelectric element 5 is connected to the first switch 162*a* and the second switch 162*b* that select a plurality of drive waveform signals. On the other hand, the common electrode 5-5 of the piezoelectric element 5 is commonly used in each case, i.e., a case where the drive waveform from the first amplifier circuit 107 is selected or a case where the drive waveform from the second amplifier circuit 108 is selected.

Therefore, when the piezoelectric element 5 is driven with the drive waveform of one of the amplifier circuits (107 or 108), the current flows into the resistance component between the ground and the negative electrode of the piezoelectric element 5, and the potential fluctuates on the negative electrode of the piezoelectric element 5. When the piezoelectric element 5 is driven with a different drive waveform generated by the other amplifier circuit while the potential has fluctuated, the potential difference applied to the piezoelectric element 5 is different from the expected potential difference. This causes droplets to be discharged at a discharge velocity different from the expected discharge velocity, deteriorates the landing accuracy of droplets, and results in the problem of a reduction in the image quality.

Figure 7:
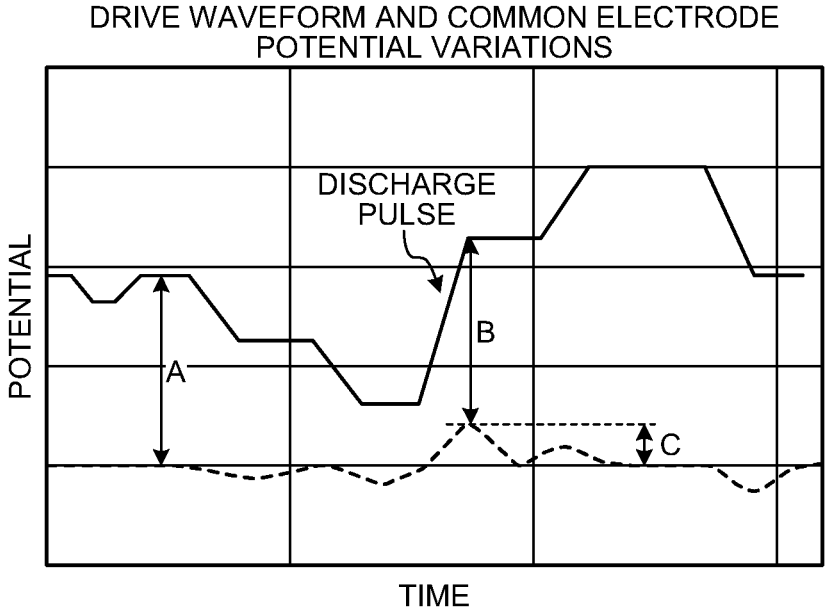
FIG. 7 is a graph illustrating timing of a discharge pulse and potential variations on a negative electrode of a piezoelectric element during driving for small droplets.

A solid graph illustrated in FIG. 7 is a graph of the potential (the potential on the positive electrode of the piezoelectric element 5) generated by the amplifier circuit based on the drive waveform for small droplets. A graph indicated in a dotted line in FIG. 7 is a graph representing potential variations on the negative electrode of the piezoelectric element 5 described above. As indicated by a potential difference A, a potential difference B, and the like, in FIG. 7, the piezoelectric element 5 is driven by the potential difference between the potential due to the drive waveform for small droplets and the potential on the negative electrode, and an actuator provided in the liquid chamber of the recording head 234 is deformed. When the potential difference is small, the volume of the liquid chamber becomes largely expanded, and the pressure in the liquid chamber decreases. When the potential difference is large, the volume of the liquid chamber becomes small, the pressure in the liquid chamber increases, and droplets are discharged.

At this point, when the potential corresponding to the drive waveform generated by the amplifier circuit is applied to the piezoelectric element 5, a current is generated in the actuator which is a capacitive load. Then, a voltage drop occurs due to the current, and the potential in the vicinity of the grounded common electrode 5-5 fluctuates as illustrated by the dotted line graph in FIG. 7. The actuator of the recording head 234 is driven via the piezoelectric element 5 due to the potential difference between the positive electrode and the negative electrode of the piezoelectric element 5. Therefore, when a potential variation C occurs in the common electrode 5-5 as illustrated in FIG. 7, the potential difference applied to the piezoelectric element 5 is reduced as illustrated by the potential difference B, and accordingly the displacement amount of the actuator is reduced.

The drive waveform illustrated as the potential difference B in FIG. 7 represents a discharge pulse for contracting the liquid chamber and discharging droplets. The droplets discharged from the nozzle are discharged at the droplet velocity and the timing (discharge timing) corresponding to the potential difference due to the discharge pulse. Here, when the effect of the potential variation on the negative electrode reduces the potential difference, the liquid chamber contracts insufficiently, and the discharge velocity of droplets becomes low. As described above, when only one type of drive waveform is simultaneously applied to the one piezoelectric element 5, the effect of the current during discharge lowers the discharge velocity of droplets. The amount of current increases as the number of drive nozzles is larger; therefore, as the number of drive nozzles is larger, the effect of velocity variations increases.

Figure 8:
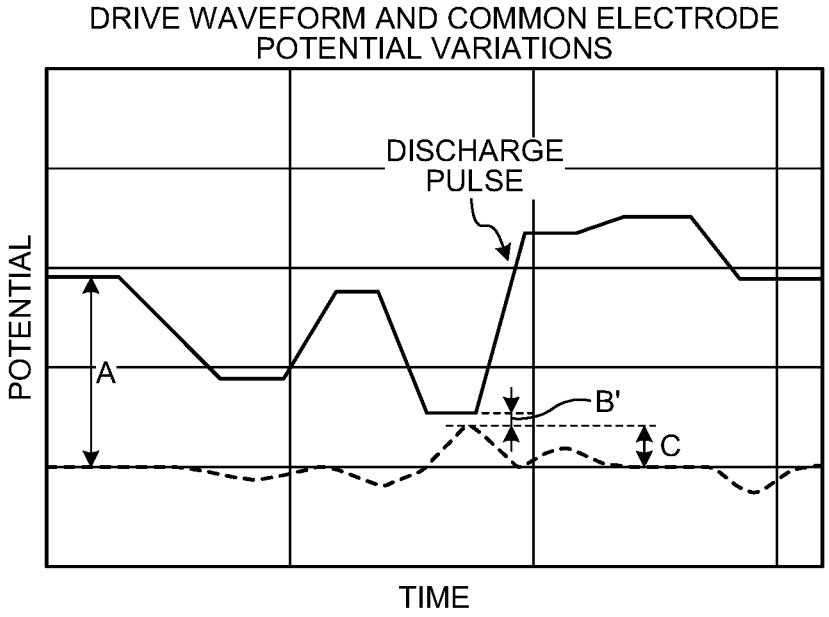
FIG. 8 is a graph illustrating timing of a discharge pulse for large-droplets driving and potential variations on the negative electrode of the piezoelectric element during mixed driving for large droplets and small droplets.

On the other hand, when large droplets and small droplets are simultaneously discharged from one nozzle based on the drive waveform for large droplets and the drive waveform for small droplets, the effect of the velocity variations of droplets changes depending on the timing of large droplets and small droplets. A solid graph illustrated in FIG. 8 is a graph representing the potential at the time of discharge of large droplets during mixed driving for discharging large droplets and small droplets. A dotted graph illustrated in FIG. 8 is a graph representing the potential of the common electrode 5-5 at the time of discharge of small droplets illustrated in FIG. 5.

The potential difference C illustrated in FIG. 8 represents the potential difference of the common electrode 5-5 that fluctuates most due to the drive waveform for small droplets.

The timing of the potential difference C is the timing at which the liquid chamber of the recording head 234 expands most during driving with the drive waveform for large droplets. When the potential difference applied to the piezoelectric element 5 decreases at this timing, the liquid chamber further expands. Accordingly, the next time the liquid chamber contracts, the variation range from expansion to contraction increases, and the velocity of discharged droplets increases.

As described above, when drive waveforms for different droplets such as large droplets and small droplets are generated by different amplifier circuits and one head having the common electrode 5-5 is driven with each drive waveform, there is a disadvantage such that the discharge velocities for large droplets and small droplets change due to the effect of each other's drive waveforms.

Next, the amount of velocity variation of droplets due to the potential variations on the negative electrode described above changes depending on the timing of large droplets and small droplets. Therefore, it is possible to select the respective timings so as not to cause the velocity variations for large droplets and small droplets. However, selecting such timing is very difficult. This is described below.

Figure 9:
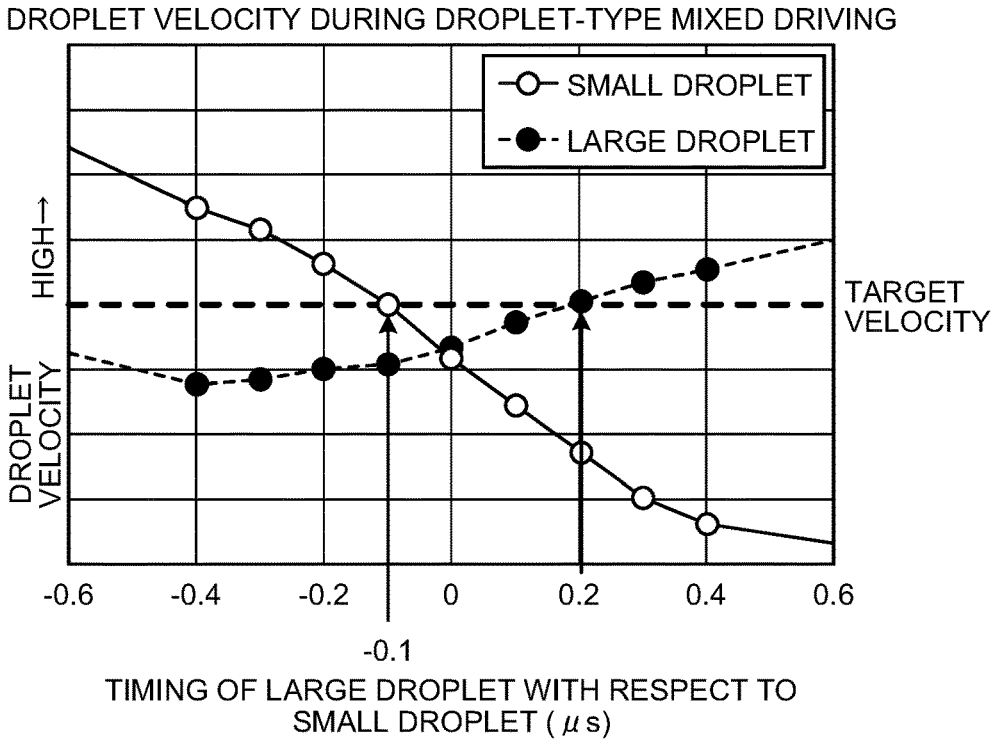
FIG. 9 is a graph illustrating velocity changes of large droplets and small droplets under a drive condition that most affects a waveform distortion.

FIG. 9 is a graph illustrating velocity changes of large droplets and small droplets under the drive condition that most affects a waveform distortion. Specifically, the graph of FIG. 9 is a graph of the recording head that drives 320 nozzles with, for example, one amplifier circuit. This graph is obtained by measuring the velocity (small droplet plot) of small droplets when one nozzle is driven to discharge small droplets and the remaining 319 nozzles are driven to discharge large droplets and the velocity (large droplet plot) of large droplets when one nozzle is driven to discharge large droplets and the remaining 319 nozzles are driven to discharge small droplets while the timing of large droplets is changed with respect to small droplets.

As illustrated in the graph of FIG. 9, it is understood that the small droplet has the desired velocity (target velocity) when the timing of −0.1 μs is selected and the large droplet has the desired velocity (target velocity) when the timing of +0.2 μs is selected.

The horizontal axis of the graph in FIG. 9 represents the relative timing of the discharge pulses for the drive waveforms for large droplets and small droplets. Therefore, it is difficult to independently select the timings for small droplets and large droplets, and for both large droplets and small droplets, it is difficult to select the timing at which the discharge velocity variations with respect to the target velocity due to waveform distortion become zero.

Operation to Set Drive Waveform

Figure 10:
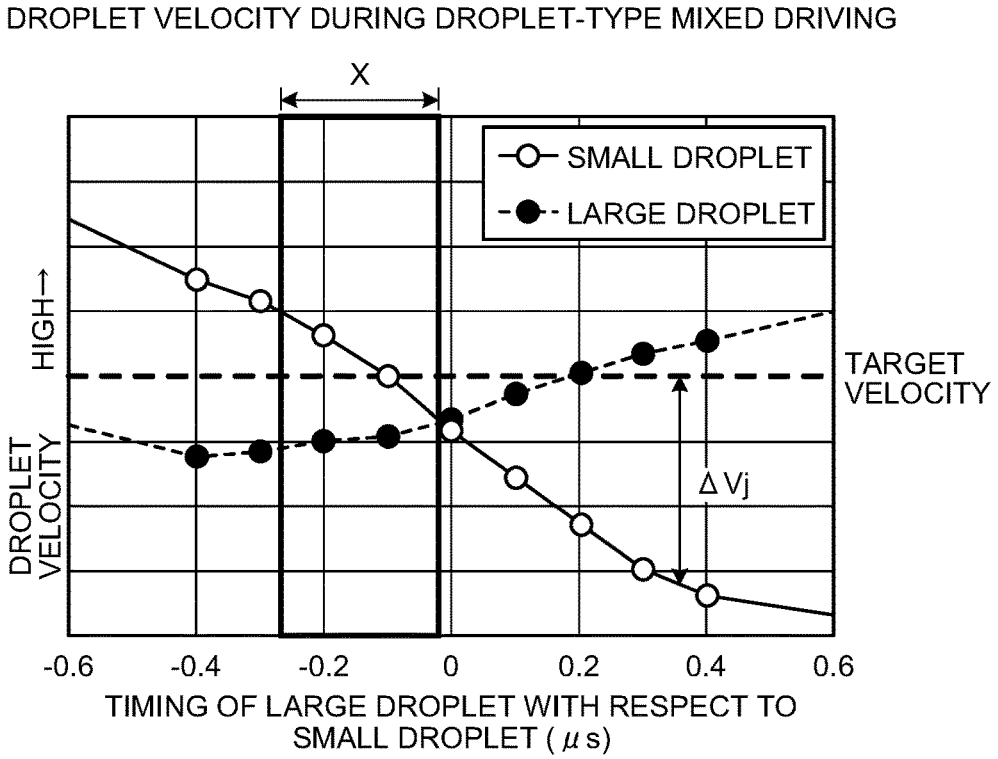
FIG. 10 is a graph illustrating an operation to select a drive waveform.

As described above, in the image forming apparatus according to the first embodiment, at the time of design of the drive waveform, the drive waveform setting control unit 170 determines the drive waveform as described below and sets (stores) the drive waveform in the drive waveform storage unit 103. FIG. 10 is a graph illustrating an operation to select the drive waveform.

At the time of design of the drive waveform, when the drive waveform setting control unit 170 determines the timings of discharge pulses for two types of drive waveforms for large droplets and small droplets for the recording head 234 that performs the above-described shading correction, the drive waveform setting control unit 170 acquires the droplet velocities under conditions A to D, described below, detected by the droplet velocity detection unit 171. Then, the drive waveform setting control unit 170 selects the drive waveform having the timing of the discharge pulse (see FIG. 7 or 8) within a range X surrounded by a solid frame illustrated in FIG. 10 and sets the drive waveform in the drive waveform storage unit 103.

The range X surrounded by the solid frame illustrated in FIG. 10 is a range where the condition of Equation (1) below is satisfied. The drive waveform setting unit 173 of the drive waveform setting control unit 170 selects the drive waveform with which the timing of the discharge pulse falls within the range X from the drive waveforms stored in the drive waveform memory 172 based on the droplet velocities for large droplets and small droplets discharged from each nozzle detected by the droplet velocity detection unit 171 at the time of design of the drive waveform and stores the drive waveform in the drive waveform storage unit 103.

$$|A-C|<|B-D| \quad (1)$$

In Equation (1), "A" is a droplet velocity (small droplet velocity) when n nozzles are driven for small droplets, and "B" is a droplet velocity (large droplet velocity) when the n nozzles are driven for large droplets. Further, "C" is a small droplet velocity when the n nozzles are driven for small droplets and the remaining nozzles are driven for large droplets, and "D" is a large droplet velocity when the n nozzles are driven for large droplets and the remaining nozzles are driven for small droplets.

Here, "n" is a natural number less than the maximum number of nozzles driven by one amplifier circuit (the first amplifier circuit 107 or the second amplifier circuit 108) in the recording head 234.

Specifically, as indicated by Equation (1), the drive waveform setting unit 173 calculates an absolute value (|A−C|) of the difference between the small droplet velocity during driving of the nozzle for only small droplets and the small droplet velocity during mixed driving for large droplets and small droplets based on the droplet velocities of large droplets and small droplets discharged from each nozzle detected by the droplet velocity detection unit 171. The drive waveform setting unit 173 calculates an absolute value (|B−D|) of the difference between the large droplet velocity during driving of the nozzle for only large droplets and the large droplet velocity during mixed driving for large droplets and small droplets. The drive waveform setting unit 173 selects the drive waveform with which |A−C| is smaller than |B−D| from the drive waveforms stored in the drive waveform memory 172. The selected drive waveform is a drive waveform with which the timing of the discharge pulse illustrated in FIG. 7 or 8 falls within the range X illustrated in FIG. 10. The drive waveform setting unit 173 sets the selected drive waveform in the drive waveform storage unit 103.

During mixed driving for large droplets and small droplets, small droplets have smaller variations with respect to the target velocity than large droplets. Therefore, even when the number of drive nozzles is changed, small droplets may be discharged at a velocity close to the target velocity, and the image quality may be improved.

Further detailed descriptions are given. The image forming apparatus often performs shading correction to correct the deviation in density by changing the ratio of large droplets to small droplets in accordance with the characteristics of the recording head 234. During the shading correction, an adjustment is made such that a large number of small droplets are used for a recording head that tends to have a large droplet size (the characteristics of each head), and a large number of large droplets is used for a recording head that tends to have a small droplet size (the characteristics of each head) so that the difference in image density between the recording heads is corrected. The reason why velocity variations of small droplets are preferentially reduced is that, when the shading correction is performed, driving all the nozzles for large droplets is not executed basically, and all images from low density to high density are formed primarily with small droplets.

Even for printing with the highest density that uses the largest number of large droplets, in a head having an average or larger size of droplets discharged from the head, not all pixels are filled with large droplets, and an image is formed by mixing a large number of small droplets. There is a possibility that large droplets are used predominantly only in a head whose droplet size corresponds to the lower limit of the head manufacturing standard value as the characteristics of the head. In addition, for typical image formation, large droplets are often used only in a high-density and monochromatic region. Therefore, large droplets are used less frequently for image formation than small droplets and therefore has a lower effect on the actual image quality than small droplets.

As described above, by preferentially adjusting variations in the discharge velocity of small droplets, the discharge velocity of small droplets may be optimized. Therefore, the droplet landing accuracy may be improved, and thus the image quality may be improved.

The drive waveform setting unit 173 selects a drive waveform with which "ΔVj", which is a deviation of small droplets from the target velocity, illustrated in FIG. 10 satisfies the condition of Equation (2) below and sets the drive waveform in the drive waveform storage unit 103. Accordingly, the first amplifier circuit 107 or the second amplifier circuit 108, which executes driving for small droplets, drives each of the piezoelectric elements 5 with the drive waveform that satisfies the condition of Equation (2) below.

$$Res/(2\times25.4\times10^{-3})\geq Vs\times((Td/Vj)-(Td/(Vj+\Delta Vj))) \quad (2)$$

In Equation (2), "Vs" is the relative velocity difference [m/s] (velocity of substrate) between the print target and the head, and "Td" is the distance [m] (through distance) from the nozzle to the print target. Further, "Vj" is the target discharge velocity [m/s] (velocity of jetting) of small droplets, and "Res" is the resolution [dpi] of the print target in the head scanning direction.

By executing driving for small droplets with the drive waveform that satisfies the condition of Equation (2), the landing deviation amount may be less than half of the dot arrangement interval calculated from the print resolution. Therefore, it is possible to significantly suppress changes in the color and the density due to unintended overlapping of dots. As the condition of Equation (2) is satisfied, the deviation of large droplets from the target velocity may be suppressed, although less prioritized than small droplets, and an image with a higher quality may be obtained.

Operation to Select Head Having Small Droplet Size to Discharge Yellow Ink

When an image is formed by using four colors of black, cyan, magenta, and yellow, the head drive control unit 109 illustrated in FIG. 6 selects, as the head that discharges yellow ink, a head having a relatively small droplet size as compared with the heads that discharge other color inks. That is, due to head manufacturing variations, a head having a small droplet size often uses large droplets when performing shading correction. Therefore, the head drive control unit 109 selects and uses a head having a small droplet size to discharge yellow ink, which is less likely to have an effect even though the landing position deviates. Thus, an image with a higher quality may be obtained without decreasing the yield.

Advantage of First Embodiment

As it is clear from the above description, in the image forming apparatus according to the first embodiment, the drive waveform setting unit 173 calculates the absolute value (|A−C|) of the difference between the small droplet velocity for driving of the nozzles only for small droplets and the small droplet velocity for mixed driving for large droplets and small droplets based on the droplet velocities of large droplets and small droplets discharged from each of the nozzles, detected by the droplet velocity detection unit 171. The drive waveform setting unit 173 calculates the absolute value (|B−D|) of the difference between the large droplet velocity for driving of the nozzles only for large droplets and the large droplet velocity for mixed driving for large droplets and small droplets. The drive waveform setting unit 173 selects the drive waveform with which |A−C| is smaller than |B−D| from the drive waveforms stored in the drive waveform memory 172 and drives each of the piezoelectric elements.

When mixed driving for large droplets and small droplets are executed, small droplets have smaller variations with respect to the target velocity than large droplets. Therefore, even when the number of drive nozzles is changed, small droplets may be discharged at a velocity close to the target velocity. Thus, the discharge velocity of droplets may be optimized, and the image quality may be improved in accordance with an improvement in the droplet landing accuracy.

The first amplifier circuit 107 and the second amplifier circuit 108, the two amplifier circuits in total, make it possible to selectively jet three types of droplets, i.e., large droplets, medium droplets, and small droplets. Therefore, the number of amplifier circuits needed may be reduced to two, and accordingly the configuration of the image forming apparatus may be simplified, and the manufacturing cost may be reduced.

When an image is formed by using four colors, black, cyan, magenta, and yellow, the head drive control unit 109 illustrated in FIG. 6 selects, as the head that discharges yellow ink, a head having a relatively small droplet size as compared with the heads that discharge other color inks. Accordingly, the printed image may be less affected by the deviation of the landing location, and an image with a higher quality may be obtained without decreasing the yield.

Second Embodiment

Next, the image forming apparatus according to a second embodiment is described. The first embodiment described above and the second embodiment described below are different in the method for determining the discharge pulse of the drive waveform and are the same in the configuration and the operation. Therefore, only the method for determining the discharge pulse of the drive waveform, which is a difference, is described below, and the duplicate descriptions are omitted.

In the image forming apparatus according to the first embodiment described above, large droplets and small droplets are selectively jetted; however, in the image forming apparatus according to the second embodiment, three types of droplets, i.e., large droplets, medium droplets, and small droplets, are selectively jetted. In the image forming apparatus according to the second embodiment, the three types of droplets are selectively jetted by two amplifier circuits, i.e., the first amplifier circuit 107 and the second amplifier circuit 108 illustrated in FIG. 6. In this case, one of the amplifier circuits is driven to discharge one type of droplets, and the other amplifier circuit is driven to discharge the other two types of droplets.

Among the three types of droplets, two types of droplets are both discharged by driving the other amplifier circuit with the common drive waveform. Therefore, the timing (see FIGS. 7 and 8) of the discharge pulse of the drive waveform for the two types of droplets is the identical timing. Therefore, the timing of the discharge pulse relative to the remaining one type of droplets may be considered.

Specifically, even in an image system using large droplets, medium droplets, and small droplets, as described above, driving all the nozzles to discharge large droplets is not executed basically. Images in areas from low density to high density are formed primarily using medium droplets and small droplets. Therefore, it is preferable to set the timing of the discharge pulse such that the droplet velocities of medium droplets and small droplets do not deviate from the target rather than large droplets.

Specifically, the first amplifier circuit 107, for example, is driven with the common drive waveform to produce large droplets and medium droplets, and the second amplifier circuit 108 is driven with a small-droplet drive waveform to produce small droplets. The first amplifier circuit 107 may be driven with a small-droplet drive waveform to produce small droplets, and the second amplifier circuit 108 may be driven with the common drive waveform to produce large droplets and medium droplets.

In this case, the drive waveform setting unit 173 of the image forming apparatus according to the second embodiment selects the drive waveform with which the timing of the discharge pulse falls within the range (=within the range X illustrated in FIG. 10) where the condition of Equation (3) below is satisfied from the drive waveforms stored in the drive waveform memory 172 based on the droplet velocities of large droplets and small droplets discharged from each of the nozzles detected by the droplet velocity detection unit 171 at the time of design of the drive waveform and sets the drive waveform in the drive waveform storage unit 103.

$$|A-C|<|B-D| \quad (3)$$

In Equation (3), "A" is a droplet velocity (small droplet velocity) when the n nozzles are driven for small droplets, and "B" is a droplet velocity (large droplet velocity) when the n nozzles are driven for large droplets. Further, "C" is a small droplet velocity when the n nozzles are driven for small droplets and the remaining nozzles are driven for large droplets, and "D" is a large droplet velocity when the n nozzles are driven for large droplets and the remaining nozzles are driven for small droplets.

Here, "n" is a natural number less than the maximum number of nozzles driven by one amplifier circuit (the first amplifier circuit 107 or the second amplifier circuit 108) in the recording head 234.

Advantage of Second Embodiment

During mixed driving for large droplets, medium droplets, and small droplets, small droplets have smaller variations with respect to the target velocity than large droplets and medium droplets. Therefore, even when the number of drive nozzles is changed, small droplets may be discharged at a velocity close to the target velocity, the image quality may be improved in accordance with an improvement in the landing accuracy, and the same advantage as that in the above-described first embodiment may be obtained.

Third Embodiment

Next, the image forming apparatus according to a third embodiment is described. In the example of the second embodiment described above, either one of the first amplifier circuit 107 and the second amplifier circuit 108 is driven for large droplets and medium droplets, and the other amplifier circuit is driven for small droplets. Conversely, in an example of the third embodiment, either one of the first amplifier circuit 107 and the second amplifier circuit 108 is driven for large droplets, and the other amplifier circuit is driven for medium droplets and small droplets.

The second embodiment described above and the third embodiment described below are different in the method for determining the discharge pulse of the drive waveform and are the same in the configuration and the operation. Therefore, only the method for determining the discharge pulse of the drive waveform, which is a difference, is described below, and duplicate descriptions are omitted.

In the case of the image forming apparatus according to the third embodiment, for example, the first amplifier circuit 107 is driven with a large-droplet drive waveform to produce large droplets, and the second amplifier circuit 108 is driven with the common drive waveform to produce medium droplets and small droplets. The first amplifier circuit 107 may be driven with the common drive waveform to produce medium droplets and small droplets, and the second amplifier circuit 108 may be driven with a large-droplet drive waveform to produce large droplets.

In this case, the drive waveform setting unit 173 of the image forming apparatus according to the third embodiment selects the drive waveform with which the timing of the discharge pulse falls within the range (=within the range X illustrated in FIG. 10) where the condition of Equation (4) below is satisfied from the drive waveforms stored in the drive waveform memory 172 based on the droplet velocities of large droplets and small droplets discharged from each of the nozzles detected by the droplet velocity detection unit 171 at the time of design of the drive waveform and sets the drive waveform in the drive waveform storage unit 103.

$$|A-C|<|B-D| \quad (4)$$

In Equation (4), "A" is a droplet velocity (small droplet velocity) when the n nozzles are driven for small droplets, and "B" is a droplet velocity (large droplet velocity) when the n nozzles are driven for large droplets. Further, "C" is a small droplet velocity when the n nozzles are driven for small droplets and the remaining nozzles are driven for large droplets, and "D" is a large droplet velocity when the n nozzles are driven for large droplets and the remaining nozzles are driven for small droplets.

Here, "n" is a natural number less than the maximum number of nozzles driven by one amplifier circuit (the first amplifier circuit 107 or the second amplifier circuit 108) in the recording head 234.

Advantage of Third Embodiment

In the case of the image forming apparatus according to the third embodiment as described above, the two amplifier circuits, i.e., the first amplifier circuit 107 and the second amplifier circuit 108, may be driven separately for infrequently used large droplets and for frequently used medium droplets and small droplets. Therefore, the droplet velocities of both medium droplets and small droplets may be adjusted with respect to large droplets, and the image quality may be further improved.

Fourth Embodiment

Next, the image forming apparatus according to a fourth embodiment is described. In the example of the third embodiment described above, either one of the first amplifier circuit 107 and the second amplifier circuit 108 is driven for large droplets, and the other amplifier circuit is driven for medium droplets and small droplets. Conversely, in the example of the fourth embodiment, either one of the first amplifier circuit 107 and the second amplifier circuit 108 is driven for large droplets and small droplets, and the other amplifier circuit is driven for medium droplets.

The third embodiment described above and the fourth embodiment described below are different in the method for determining the discharge pulse of the drive waveform and are the same in the configuration and the operation. Therefore, only the method for determining the discharge pulse of the drive waveform, which is a difference, is described below, and duplicate descriptions are omitted.

In the case of the image forming apparatus according to the fourth embodiment, for example, the first amplifier circuit 107 is driven with the common drive waveform to produce large droplets and small droplets. The second amplifier circuit 108 is driven with a medium-droplet drive waveform to produce medium droplets. The first amplifier circuit 107 may be driven with a medium-droplet drive waveform to produce medium droplets, and the second amplifier circuit 108 may be driven with the common drive waveform to produce large droplets and small droplets.

In this case, the drive waveform setting unit 173 of the image forming apparatus according to the fourth embodiment selects the drive waveform with which the timing of the discharge pulse falls within the range (=within the range X illustrated in FIG. 10) where the condition of Equation (5) below is satisfied from the drive waveforms stored in the drive waveform memory 172 based on the droplet velocities of large droplets and medium droplets discharged from each of the nozzles detected by the droplet velocity detection unit 171 at the time of design of the drive waveform and sets the drive waveform in the drive waveform storage unit 103.

$$|A-C|<|B-D| \tag{5}$$

In Equation (5), "A" is a droplet velocity (medium droplet velocity) when the n nozzles are driven for medium droplets, and "B" is a droplet velocity (large droplet velocity) when the n nozzles are driven for large droplets. Further, "C" is a medium droplet velocity when the n nozzles are driven for medium droplets and the remaining nozzles are driven for large droplets, and "D" is a large droplet velocity when the n nozzles are driven for large droplets and the remaining nozzles are driven for medium droplets.

Here, "n" is a natural number less than the maximum number of nozzles driven by one amplifier circuit (the first amplifier circuit 107 or the second amplifier circuit 108) in the recording head 234.

Advantage of Fourth Embodiment

With the image forming apparatus according to the fourth embodiment described above, medium droplets may be discharged at a velocity close to the target velocity, the image quality may be improved in accordance with an improvement in the landing accuracy, and the same advantage as that in each of the above-described embodiments may be obtained.

Fifth Embodiment

Next, the image forming apparatus according to a fifth embodiment is described. Each of the above-described embodiments is an example of application to a serial-engine type image forming apparatus. On the other hand, the fifth embodiment is an example of application to a line-engine type image forming apparatus that forms images by discharging droplets from a nozzle array corresponding to a predetermined length (for example, corresponding to the length of a sheet in the width direction (direction perpendicular to the conveying direction)) along the main scanning direction perpendicular to the conveying direction of the discharge target to which droplets are discharged. Each of the above-described embodiments and the fifth embodiment described below are different only in the printing method. Therefore, only the difference between them is described, and duplicate descriptions are omitted.

Figure 11:
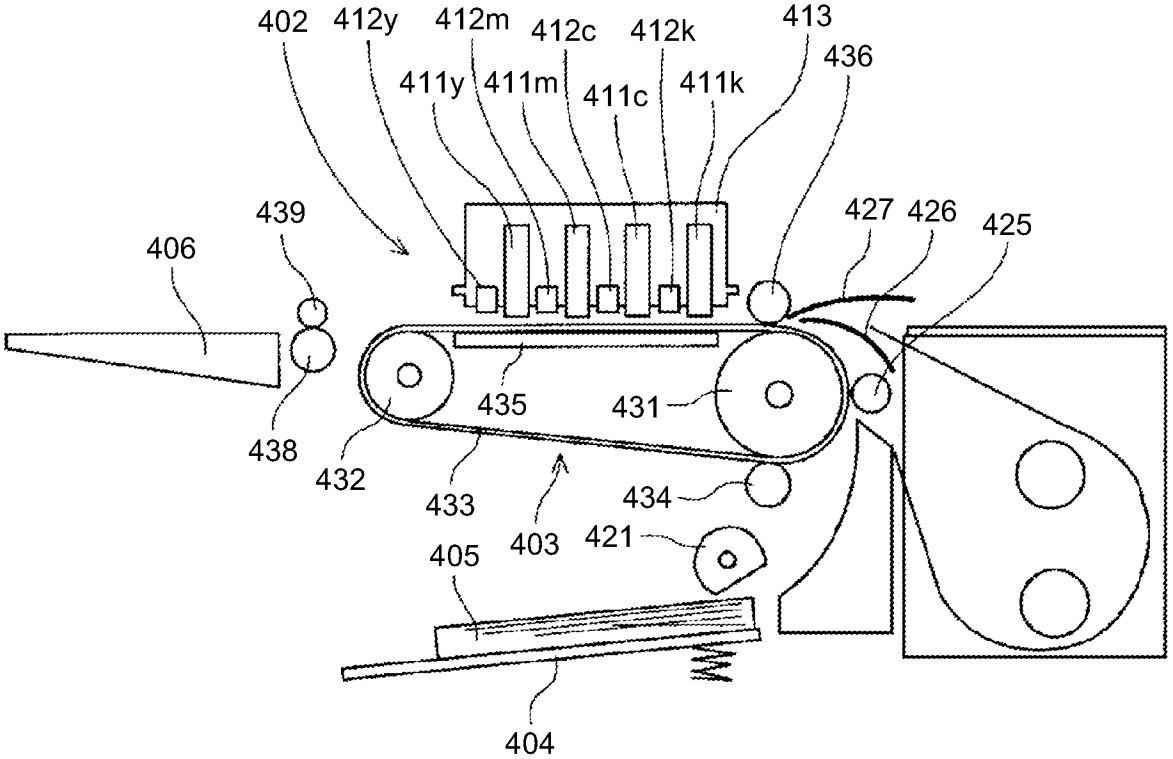
FIG. 11 is a cross-sectional view of a line-engine type image forming apparatus according to a fifth embodiment on a vertical cross-section along the conveying direction of a sheet.

FIG. 11 is a cross-sectional view of the line-engine type image forming apparatus according to the fifth embodiment on a vertical cross-section along the conveying direction of a sheet. The line-engine type image forming apparatus includes a full-line head and includes, in the apparatus main body, an image forming unit 402, a conveyance mechanism 403 that conveys a sheet, and the like. A sheet feeding tray 404 is provided on one side of the apparatus main body to load a large number of sheets 405. The sheet 405 fed from the sheet feeding tray 404 is conveyed by the sub-scanning conveyance mechanism 403 so that a predetermined image is recorded by the image forming unit 402. Subsequently, the sheet 405 is ejected to a paper ejection tray 406 mounted on the other side of the apparatus main body.

The image forming unit 402 includes line heads 412*y*, 412*m*, 412*c*, and 412*k* including a nozzle array that is integrated with liquid tanks 411*y*, 411*m*, 411*c*, and 411*k* containing liquid as recording liquid and corresponds to the length of the sheet in the width direction (direction perpendicular to the conveying direction). The line heads 412*y*, 412*m*, 412*c*, and 412*k* are attached to a head holder 413.

The line heads 412*y*, 412*m*, 412*c*, and 412*k* discharge droplets in colors in a sequence, for example, starting with black, cyan, magenta, and then yellow, from the upstream side in the sheet conveying direction. As the line head, it is possible to use one head in which a plurality of nozzle arrays is arranged at predetermined intervals to discharge droplets in colors, or use a head and a liquid cartridge that are separated from each other.

The sheet 405 in the sheet feeding tray 404 is separated one by one by a sheet feeding roller 421, is fed into the apparatus main body, and is conveyed to the conveyance mechanism 403 by a sheet supply roller. The conveyance mechanism 403 includes a conveyance belt 433 extending between a drive roller 431 and a driven roller 432 and a charge roller 434 that charges the conveyance belt 433.

The conveyance mechanism 403 includes a guide member (platen plate) 435 that guides the conveyance belt 433 at a portion opposed to the image forming unit 402, and a recording liquid wiping member (cleaning roller) 425 that is made of a porous body to remove the recording liquid (ink) adhering to the conveyance belt 433.

The conveyance mechanism 403 includes a static elimination roller mainly including conductive rubber to eliminate static electricity of the sheet 405, and a sheet pressing roller 436 that presses the sheet 405 against the conveyance belt 425. On the downstream side of the conveyance mechanism 403, paper ejection rollers 438 and 439 are provided to feed the sheet 405 having an image recorded thereon to the paper ejection tray 406.

In the line-type image forming apparatus having the above configuration, too, when the sheet 405 is fed while the conveyance belt 433 is charged, the sheet 405 is attracted to the conveyance belt 425 due to electrostatic force and is conveyed in accordance with the rotational movement of the conveyance belt 433, an image is formed by the image forming unit 402, and then the sheet is ejected to the paper ejection tray 406.

Even for such a line-engine type image forming apparatus, it is possible to improve the image quality by optimizing the discharge velocity of droplets and improving the landing accuracy of droplets in the same manner as that described above.

Finally, the above-described embodiments are presented as examples, and there is no intention to limit the scope of the present invention. This novel embodiment may be implemented in various other forms, and various changes, omissions, and replacements may be made without departing from the gist of the invention.

For example, the present invention is applicable to a single-function apparatus such as a printer, a facsimile machine, or a copier, or a multifunction peripheral thereof. It is also applicable to an image forming apparatus such as a three-dimensional printer that discharges a recording liquid, which is a liquid other than ink, or a fixing processing liquid, or a liquid discharge apparatus that discharges other liquids. In either case, the quality of a product may be improved by optimizing the discharge velocity of droplets and improving the landing accuracy in the same manner as that described above.

In the present application, the "apparatus that discharges the liquid" is an apparatus that includes a liquid discharge head or a liquid discharge unit and drives the liquid discharge head to discharge the liquid. The apparatus that discharges the liquid includes not only an apparatus capable of discharging a liquid to an object to which the liquid may adhere, but also an apparatus that discharges a liquid toward the air or liquid.

The "apparatus that discharges the liquid" may also include units for feeding, conveying, and discharging the object to which the liquid may adhere, a pre-processing apparatus, a post-processing apparatus, etc.

Examples of the "apparatus that discharges the liquid" include an image forming apparatus that is an apparatus that discharges ink to form an image on a sheet and a solid modeling apparatus (three-dimensional modeling apparatus) that discharges a modeling liquid to a powder layer, which is obtained by forming powder in the form of layer, to form a solid object (three-dimensional object).

The "apparatus that discharges the liquid" is not limited to an apparatus that visualizes a meaningful image such as character or figure with the discharged liquid. Apparatuses that form a pattern that has no meaning in itself and that form a three-dimensional image are also included.

The above-described "object to which the liquid may adhere" refer to an object to which the liquid may adhere at least temporarily, an object to which the liquid adheres and gets fastened, and the object to which the liquid adheres and permeates. Specific examples include media, e.g., recording media such as sheets, recording paper, recording sheets, films, or cloth, electronic components such as electronic substrates or piezoelectric elements, powder layers (particle layers), organ models, and cells for examination, and include anything to which the liquid adheres unless otherwise specified.

A material of the above-described "object to which the liquid may adhere" may be paper, thread, fiber, cloth, leather, metal, plastic, glass, wood, ceramics, etc., as long as the liquid may adhere even temporarily.

Although there is no particular limitation on the "liquid" as long as the liquid has a viscosity and surface tension that allows discharge from the head, it is preferable to have a viscosity of 30 mPa·s or less at normal temperature and normal pressure or due to heating or cooling. More specifically, it is a solvent, suspension, emulsion, or the like, including a solvent such as water or organic solvent, colorant such as dye or pigment, polymerizable compound, resin, functionalization material such as surfactant, biocompatible material such as DNA, amino acid, protein, or calcium, edible material such as natural pigment, etc. They may be used as, for example, inkjet ink, surface processing liquid, liquid for forming a constituent element such as electronic element or light emitting element or an electronic circuit resist pattern, material liquid for three-dimensional modeling, etc.

The "apparatus that discharges the liquid" includes an apparatus in which the liquid discharge head and the object to which the liquid may adhere are moved relatively, but this is not a limitation. Specific examples include a serial type apparatus that moves the liquid discharge head and a line type apparatus that does not move the liquid discharge head.

Other examples of the "apparatus that discharges the liquid" include a processing liquid application apparatus that discharges a processing liquid to a sheet to apply the processing liquid to a surface of the sheet for the purpose of, for example, reforming the surface of the sheet, and an injection granulation apparatus that granulates fine particles of a raw material by injecting, through a nozzle, constituent humor obtained by dispersing the raw material in a solution.

There is no limitation on a pressure generating unit used in "the liquid discharge head (the recording head 234)". It is possible to use, for example, a thermal actuator using an electrothermal conversion element such as a heat generating resistor or an electrostatic actuator including a diaphragm and an opposite electrode in addition to the piezoelectric actuator (which may use a laminated piezoelectric element) described in the above embodiment.

Terms in the present application, such as image formation, recording, printing, typing, copying, and modeling are all synonyms.

The "liquid discharge unit" is an integrated combination of a liquid discharge head and a functional part or mechanism and is a set of parts related to liquid discharge. Examples of the "liquid discharge unit" include a combination of a liquid discharge head and at least one of a head tank, a carriage, a supply mechanism, a maintenance/recovery mechanism, and a main-scanning movement mechanism.

Here, the "integrated combination" refers to, for example, fixing the liquid discharge head and the functional component or mechanism to each other by fastening, adhesion, engagement, or the like, or having one of them held movably with respect to the other. The liquid discharge head and the functional part or mechanism may be configured to be detachably attached to each other.

Examples of the liquid discharge unit include an integrated combination of a liquid discharge head and a head tank. Also, examples of the liquid discharge unit include an integrated combination of a liquid discharge head and a head tank connected to each other via a tube, etc. Here, it is also possible to add a unit including a filter between the head tank and the liquid discharge head in the liquid discharge unit.

Examples of the liquid discharge unit include an integrated combination of a liquid discharge head and a carriage.

Examples of the liquid discharge unit include an integrated combination of a liquid discharge head and a main-scanning movement mechanism in such a manner that the liquid discharge head is movably held by a guide member that forms a part of the main-scanning movement mechanism. Examples of the liquid discharge unit include an integrated combination of a liquid discharge head, a carriage, and a main-scanning movement mechanism.

Examples of the liquid discharge unit include an integrated combination of a liquid discharge head, a carriage, and a maintenance/recovery mechanism in such a manner that the liquid discharge head is attached to the carriage and a cap member, which is a part of the maintenance/recovery mechanism, is fixed to the carriage.

Examples of the liquid discharge unit include an integrated combination of a liquid discharge head and a supply mechanism in such a manner that the liquid discharge head having a head tank or a flow path part attached thereto is coupled to a tube. A liquid in a liquid storage source is supplied to the liquid discharge head through the tube.

The main-scanning movement mechanism includes the guide member alone. The supply mechanism includes the tube alone or a mounting unit alone.

The embodiment and a modification of the embodiment are included in the scope and gist of the invention and are included in the invention described in claims and the range of equivalent thereof.

According to an embodiment, it is possible to optimize the discharge velocity of droplets, improve the landing accuracy of droplets, and improve the image quality.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a discharge head configured to drive each of drive units of nozzles based on a drive waveform to discharge a droplet; and at least two waveform feed units configured to feed a plurality of types of drive waveforms for generating droplets having different sizes to a positive electrode of each of the drive units having negative electrodes commonly grounded, wherein the waveform feed unit is configured to drive the drive units with drive waveforms with which timing of discharge pulses for discharging droplets fall within a range where a condition $|A-C|<|B-D|$ is satisfied, where "A" is a discharge velocity of a droplet having a first size when a predetermined number of drive units among the drive units of all the nozzles of the discharge head are driven to discharge a droplet having the first size, "B" is a discharge velocity of a droplet having a second size larger than the first size when a predetermined number of drive units among the drive units of all the nozzles of the discharge head are driven to discharge a droplet having the second size, "C" is a discharge velocity of a droplet having the first size when a predetermined number of drive units among the drive units of all the nozzles of the discharge head are driven to discharge a droplet having the first size and a remaining drive unit is driven to discharge a droplet having the second size, and "D" is a discharge velocity of a droplet having the second size when a predetermined number of drive units among the drive units of all the nozzles of the discharge head are driven to discharge a droplet having the second size and a remaining drive unit is driven to discharge a droplet having the first size.

2. The liquid discharge apparatus according to claim 1, wherein the waveform feed unit includes a first waveform feed unit and a second waveform feed unit, the first waveform feed unit is configured to feed, to the drive unit, a drive waveform for generating a droplet having a third size being a size between the first size and the second size and a drive waveform for the second size, and the second waveform feed unit is configured to feed a drive waveform for the first size to the drive unit.

3. The liquid discharge apparatus according to claim 1, wherein the waveform feed unit includes a first waveform feed unit and a second waveform feed unit, the first waveform feed unit is configured to feed a drive waveform for the second size to the drive unit, and the second waveform feed unit configured to feed, to the drive unit, a drive waveform for generating a droplet having a third size being a size between the first size and the second size and a drive waveform for generating a droplet having the first size.

4. The liquid discharge apparatus according to claim 1, wherein the waveform feed unit includes a first waveform feed unit and a second waveform feed unit, the first waveform feed unit is configured to feed drive waveforms for the first size and the second size to the drive unit, the second waveform feed unit is configured to feed, to the drive unit, a drive waveform for generating a droplet having a third size being a size between the first size and the second size, and the waveform feed unit is configured to drive the drive units with drive waveforms with which timing of discharge pulses for discharging droplets falls within a range where a condition $|A-C|<|B-D|$ is satisfied, where "A" is a discharge velocity of a droplet having the third size when a predetermined number of drive units among the drive units of all the nozzles of the discharge head are driven to discharge a droplet having the third size, "B" is a discharge velocity of a droplet having the second size when a predetermined number of drive units among the drive units of all the nozzles of the discharge head are driven to discharge a droplet having the second size, "C" is a discharge velocity of a droplet having the third size when a predetermined number of drive units among the drive units of all the nozzles of the discharge head are driven to discharge a droplet having the third size and a remaining drive unit is driven to discharge a droplet having the second size, and "D" is a discharge velocity of a droplet having the second size when a predetermined number of drive units among the drive units of all the nozzles of the discharge head are driven to discharge a droplet having the second size and a remaining drive unit is driven to discharge a droplet having the third size.

5. The liquid discharge apparatus according to claim 1, wherein the drive waveform for the first size satisfies a condition "$Res/(2\times25.4\times10^{-3})\geq Vs\times((Td/Vj)-(Td/(Vj+\Delta Vj)))$", where "Vs" is a relative velocity difference between the discharge head and an object to which a droplet is discharged, "Td" is a distance from a nozzle discharging the droplet to the object, "Vj" is a target discharge velocity for the first size, "Res" is a resolution of the discharge head in a scanning direction, and "ΔVj" is a deviation of the droplet having the first size from the target discharge velocity.

6. The liquid discharge apparatus according to claim 1, further comprising a head drive control unit configured to change an abundance ratio of droplets having different sizes for each discharge head or for each predetermined region to which droplets are discharged.

7. The liquid discharge apparatus according to claim 6, wherein the discharge head includes discharge heads configured to discharge ink in colors of cyan, magenta, yellow, and black, and the head drive control unit is configured to select, as a discharge head configured to discharge yellow ink, a discharge head configured to discharge a droplet having a smaller size as compared to discharge heads configured to discharge ink in the other colors, from the discharge heads.

8. A serial-engine type image forming apparatus comprising the liquid discharge apparatus according to claim 1, wherein the serial-engine type image forming apparatus is configured to move the discharge head of the liquid discharge apparatus in a main scanning direction perpendicular to a conveying direction of a discharge target to which droplets are discharged to form an image.

9. A line-engine type image forming apparatus comprising the liquid discharge apparatus according to claim 1, wherein the liquid discharge apparatus is configured to discharge droplets from a nozzle array corresponding to a predetermined length along a main scanning direction perpendicular to a conveying direction of a discharge target to which the droplets are discharged to form an image.

10. A drive waveform generation method by a liquid discharge apparatus including: a discharge head configured to drive each of drive units of nozzles based on a drive waveform to discharge droplets; and at least two waveform feed units configured to feed a plurality of types of drive waveforms for generating droplets having different sizes to a positive electrode of each of the drive units having negative electrodes commonly grounded, the drive waveform generation method comprising, by a drive waveform generation unit, generating drive waveforms with which timing of discharge pulses for discharging droplets falls within a range where a condition $|A-C|<|B-D|$ is satisfied, where "A" is a discharge velocity of a droplet having a first size when a predetermined number of drive units among the drive units of all the nozzles of the discharge head are driven to discharge a droplet having the first size, "B" is a discharge velocity of a droplet having a second size larger than the first size when a predetermined number of drive units among the drive units of all the nozzles of the discharge head are driven to discharge a droplet having the second size, "C" is a discharge velocity of a droplet having the first size when a predetermined number of drive units among the drive units of all the nozzles of the discharge head are driven to discharge a droplet having the first size and a remaining drive unit is driven to discharge a droplet having the second size, and "D" is a discharge velocity of a droplet having the second size when the predetermined number of drive units among the drive units of all the nozzles of the discharge head are driven to discharge a droplet having the second size and a remaining drive unit is driven to discharge a droplet having the first size.

* * * * *